United States Patent [19]

Tattam

[11] 4,264,009

[45] Apr. 28, 1981

[54] BOX HAVING A SECURITY STRIP

[76] Inventor: Francis E. Tattam, Neild House, Beamond End, near Amersham, Buckinghamshire, England

[21] Appl. No.: 933,439

[22] Filed: Aug. 14, 1978

Related U.S. Application Data

[63] Continuation of Ser. No. 791,605, Apr. 27, 1977, abandoned.

[51] Int. Cl.[3] ..... B65D 85/00; B65D 71/06

[52] U.S. Cl. ..... 206/449; 220/214; 217/66; 206/451; 206/597; 206/425; 206/807; 206/298; 206/1.5

[58] Field of Search ..... 206/449, 450, 442, 451, 206/481, 495, 554, 597, 425, 524, 9, 298, 1.5, 526, 83.5, 807, 804, 45, 16; 217/66–68; 229/16 A, 22 A, DIG. 1; 220/214

[56] References Cited

U.S. PATENT DOCUMENTS

| | | | |
|---|---|---|---|
| 1,605,901 | 11/1926 | O'Neil | 206/451 |
| 2,151,761 | 3/1939 | Hartman | 229/23 A |
| 2,332,192 | 10/1943 | Becker | 229/23 A |
| 2,811,296 | 10/1957 | Lang | 229/16 A |
| 3,330,409 | 7/1967 | Jorgensen | 206/83.5 |
| 3,344,917 | 10/1967 | Raffet | 206/451 |
| 3,369,652 | 2/1968 | Bebout | 206/299 |
| 3,655,112 | 4/1972 | Jeffers | 229/DIG. 1 |
| 3,709,358 | 1/1973 | Andrews | 206/451 |
| 3,902,595 | 9/1975 | Mori | 206/425 |
| 3,987,901 | 10/1976 | Dullinger | 206/451 |

FOREIGN PATENT DOCUMENTS

| | | | |
|---|---|---|---|
| 225617 | 1/1963 | Austria | 206/442 |
| 963942 | 5/1957 | Fed. Rep. of Germany | 206/442 |
| 243330 | 7/1926 | United Kingdom | 206/298 |

*Primary Examiner*—Herbert F. Ross

*Attorney, Agent, or Firm*—Poms, Smith, Lande & Rose

[57] ABSTRACT

A box for containing goods such as fold-flat package blanks, comprises interconnected panels including a base panel, which has a false bottom. A bar is placed on top of the contents of the box; a flexible security strip extends between the base panel and its false bottom, runs around the goods and along the bar so that its ends meet in a position visible when the assembled box is opened, the bar being loosely secured to the security strip the ends of which are fastened by e.g. a clear adhesive seal.

3 Claims, 7 Drawing Figures

BOX HAVING A SECURITY STRIP

This is a continuation, of application Ser. No. 791,605, filed Apr. 27, 1977 now abandoned.

BACKGROUND OF THE INVENTION

1. Field of the Invention

The invention relates to a box for packaging goods, a blank from which the box may be made, and a security device therefor.

In many fields, for example the supply of package blanks to pharmaceutical manufacturers, it is important to be able to box up goods in a manner permitting the integrity of the contents of the box to be ascertainable without having to resort to opening of the box to inspect its contents.

2. Description of the Prior Art

As far as the applicant is aware, prior art boxes have been provided with security strips but have been either expensive or cumbersome in use or both, and in all cases had to be removed first before the integrity of the box (or its contents) could be ascertained.

For instance, in some current practice reliance has to be placed wholly on scanning finished packages for identifying markings.

In other aspect, the present invention represents a further development of the box described and claimed in my own earlier GB-PS 1437719=CH PS 570307=DT-OS 2427337=U.S.-Pat. No. 3,941,274.

SUMMARY OF THE INVENTION

According to one aspect of the invention a box, case or carton for containing rows of fold-flat package blanks or other goods comprises a plurality of interconnected or interconnectable panels one of which is a base panel, the improvement consisting in a bar for placement on top of the contents of the box or case, at least one security strip extending from the base panel and adapted to run around the goods and along the bar so that its ends meet in a position visible when the assembled box or case is opened, means for securing the bar to the or each security strip and a fastener for fastening the ends of the or each strip.

Another aspect of the invention consists in the use, within a closable box, case or carton containing one or more rows of package blanks or other goods, of a frangible or separable security fastening that retains the goods in the relationship they occupy in the unopened box and in such position that they are readily visually scanned by the naked eye for correctness, said fastening having to be broken or separated before the packages can be taken for use and thus showing that the contents of the box have been disturbed.

The said means are preferably two collars slidably carried on the bar.

The ends of the security strip may for example be overlaid by adhesive tape which, if damaged, immediately shows that the contents of the box have been disturbed. When there is no such indication the contents can be used with confidence that they are as packed, and for example the risk of wrong packages being used for a pharmaceutical product is greatly reduced, at source.

It is a further advantage of the invention that identifying markings may readily be positioned so that a series of packages in a box provided with the security strip embodied in the invention can be seen at a glance to be correct and complete. The markings show up as continuous uninterrupted lines across the rows of packages.

Preferably, the box itself used in accordance with the invention is a fold-flat box which has to be opened out to allow the goods to be removed, so that there is very little chance of odd packages being left in a box and subsequently used in incorrect circumstances.

In a preferred embodiment, the box or case is made of a blank comprising a base panel of substantially rectangular configuration, two side panels attached to opposite sides of the base panel, two end panels attached to two other opposite sides of the base panel and a lid panel attached to one of the side panels at its side opposite from the base panel; the base panel being of laminated construction having channel means therein to accommodate at least one of said security strips, one of said side panels being formed with at least one foldable flap on its side for engaging with complementary recess(es) in the other side panel by folding about an axis at right angles to the axis of folding the side panels themselves when erecting the box; flap means and recess means disposed on the lid panel and on one of the side panel for interengagement; abutment means for interengagement between the other side panel and the lid panel.

DESCRIPTION OF THE PREFERRED EMBODIMENTS

Figure 1:
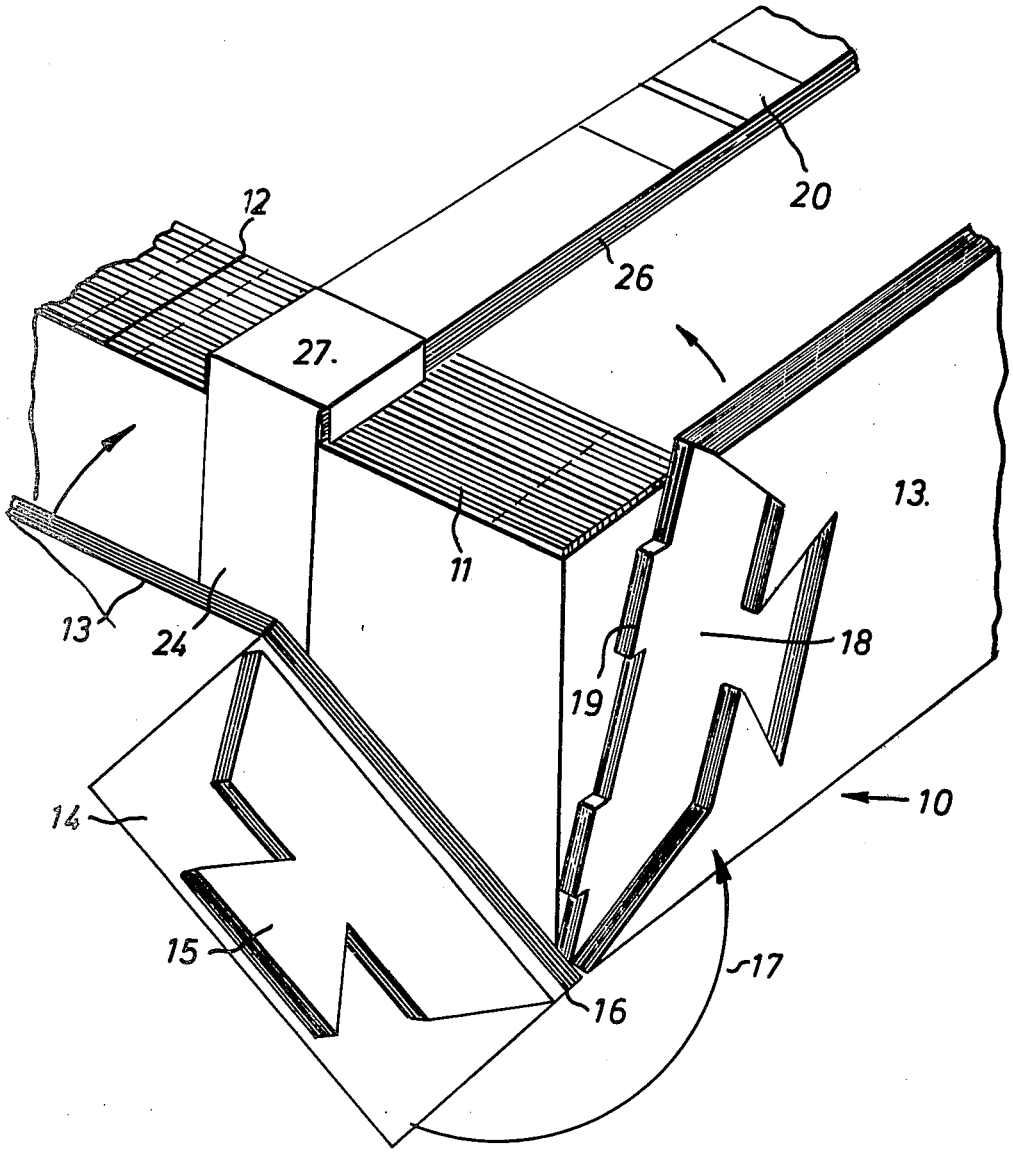
FIG. 1 is a perspective view illustrating the assembly of a box provided with a security strip in accordance with the invention.
Figure 2:
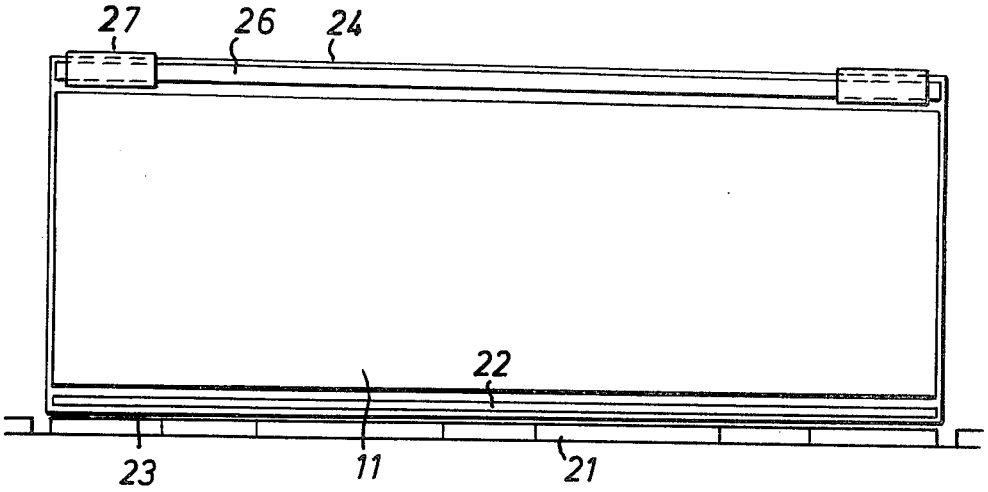
FIG. 2 is a side elevation of the box shown in FIG. 1 in its open condition.
Figure 3:
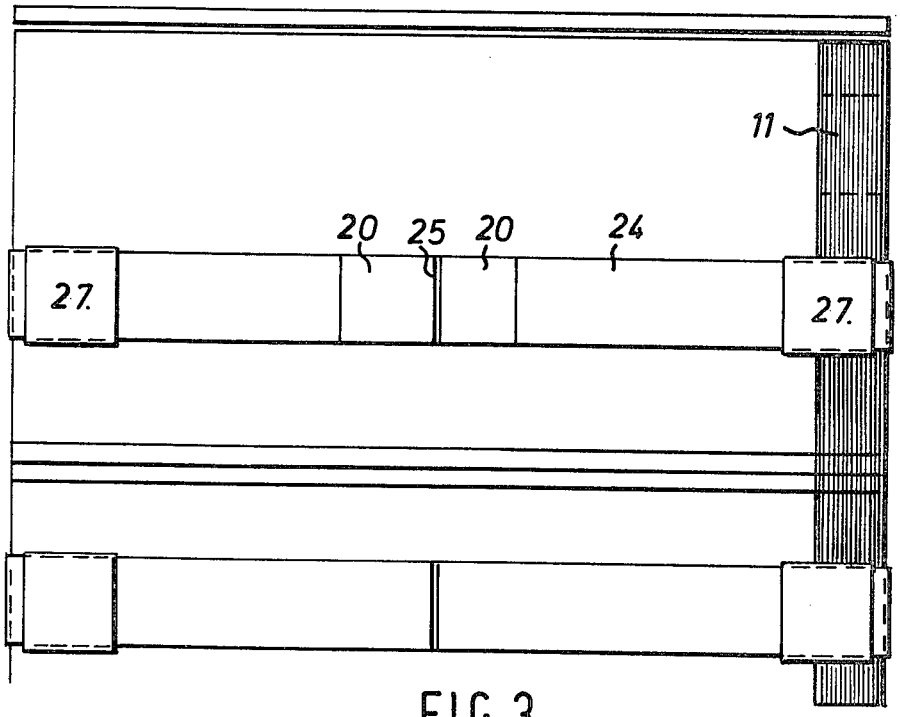
FIG. 3 is a plan view of the box shown in FIG. 1 in its assembled condition.

Referring first to FIGS. 1 to 3, there is provided a repeatedly erectable and dismantleable box 10 destined to hold, by way of example, packaging blanks for enclosing small bottles or squeeze tubes of cosmetic or pharmaceutical preparations. A row of such blanks 11 is shown in FIG. 1 and the blanks have a marking 12 such that when a plurality of said blanks are pressed together the markings 12 form a continuous line.

In the illustrated embodiment the box 10 has laminated side and end panels 13 which are adapted to be secured together in a dovetail fashion. More particularly, of the two contiguous interengageable panels 13 shown in the drawing one has a hinged flap 14 with a raised dovetail shaped land or plate 15 thereon. The flap 14 is hinged along an edge 16 so that when it is pivoted in a direction shown by arrow 17 it fits into a correspondingly shaped recess 18 in the other panel. The other panel has a pair of projecting lugs 19 which fit into slots (not shown) in the first panel.

The base panel 21 of the box 10 has a false bottom 22 such that between the panel 21 and bottom 22 a channel 23 is formed.

An elongated paper or like security strip 24 is threaded through the channel 23 such that it extends along the full length of the panel 21 and bottom 22, the full height of both end panels 13 and along the full length of the top of the blanks 11. The strips 24 are of such a length that they can overlap or the ends may abut when they encompass the desired thickness of blanks in the box in its erected condition. To secure the strips 24, thereby to hold the packaging blanks together, there is provided a bar 26 for each strip 24. Each strip 24 and its associated bar 26 are secured together by collars 27 dimensioned so that they may slide along the length of the bars and strips, the adjacent but spaced apart ends 25 of the strips 24 being fastened together by any suitable means such as a metal staple or clear adhesive tape 20.

The embodiment described so far not only provides a strong yet light box construction in which the panels may be made of paper or a laminate made of paper and expanded polystyrene but it also provides a very convenient and neat way of erecting and dismantling the box by virtue of the dovetailed interengagement of its corners and furthermore it provides an inexpensive security strip which may be made of paper or off-cuts of packaging card and which preserves the integrity of the contents of the box and prevents mistakes from being made. Furthermore, even when it is broken it can be readily replaced by passing another strip through the channels.

Figure 4:
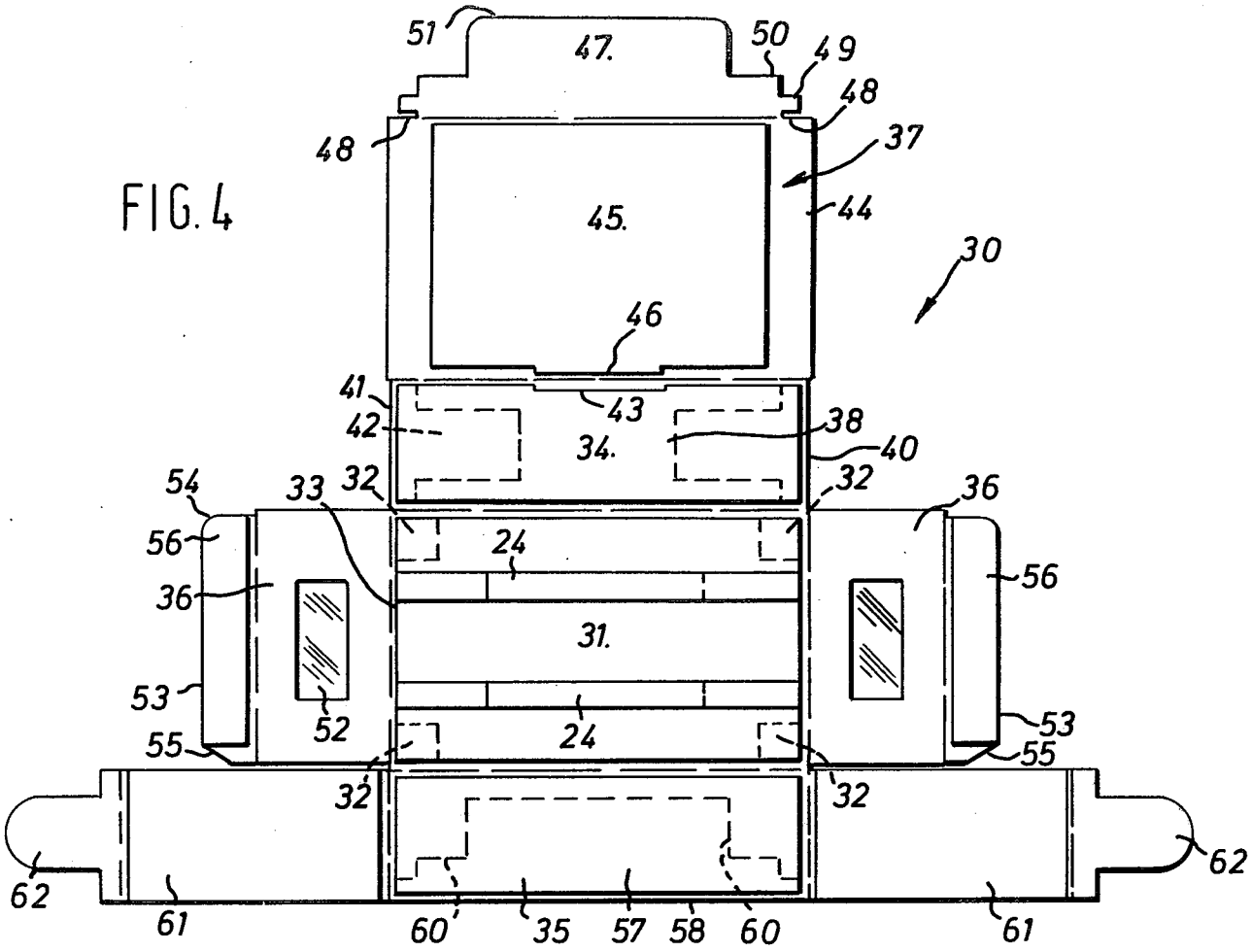
FIG. 4 is an elevation of a blank for a box according to a further embodiment of the invention and provided with security strips.
Figure 5:
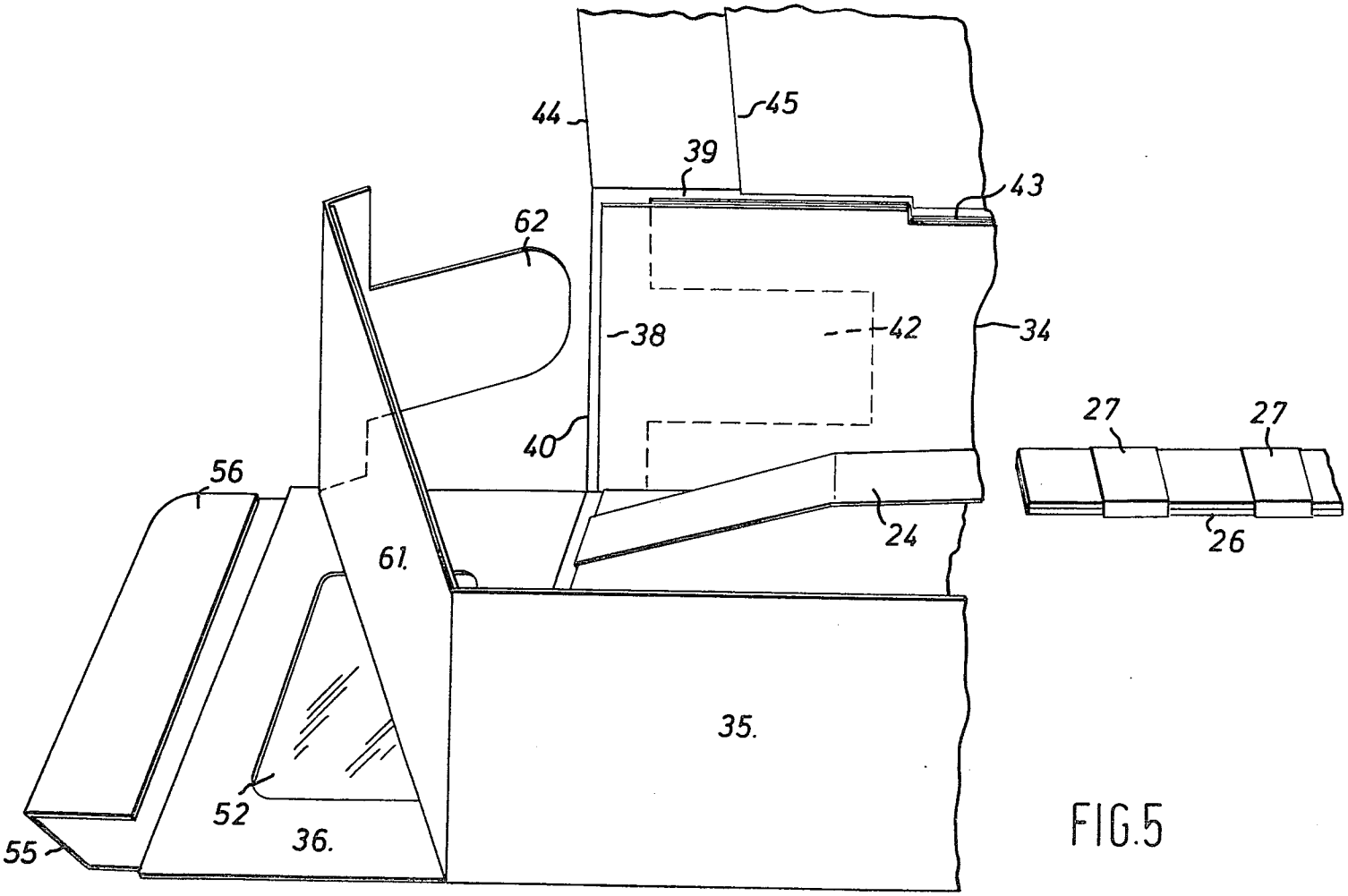
FIGS. 5 and 6 are respective fragmentary perspective views illustrating different stages of the assembly of the box shown in blank form in FIG. 4, and FIG. 7 illustrated a further variant in perspective.
Figure 6:
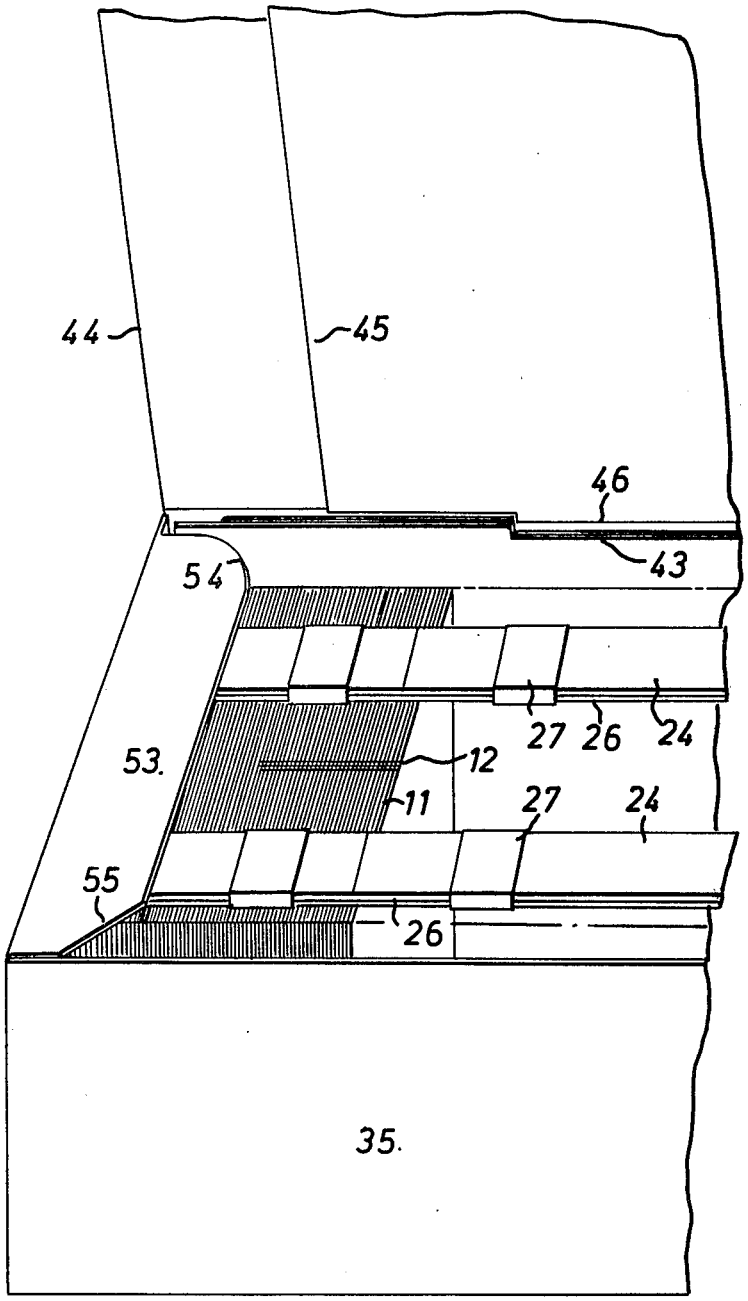

Referring now to FIGS. 4 to 6, there is shown a box blank and a box erected therefrom provided with a security strip similar to that described in the proceeding embodiment and which box is particularly advantageous in being lightweight, strong yet secure, by virtue of its construction about to be described. In these Figures, long broken lines indicate lines of fold.

The blank 30 according to FIG. 4 is essentially similar in construction to the base panel 21 of FIG. 1 in that it is of a double or false bottomed construction there being a second panel 31 thereon of somewhat smaller surface area. This panel 31 is secured to the base panel 30 by means of four corner pieces 32 shown in dotted lines in FIG. 4. In this way a broad central channel 33 is left for the insertion of two or more security strips 24 but if it is desired, a central intermediate piece could be provided at about the middle of the channel 33 so as to divide the latter into two discrete channels.

In FIG. 4 the two strips 24 are shown only schematically and for details, which are essentially similar to those already described, reference should be had to FIGS. 5 and 6 below.

The panels 30 and 31 are integral with two longitudinally adjacent side panels 34, 35 and two transversely adjacent end panels 36. The side panel 34 is connected on its side remote from the base panel 31 to a top panel 37. These panels will now be described in further detail.

The side panel 34 is of a double thickness construction having a top plate 38 glued by an intermediate plate 39 (FIG. 5) to its base 40. The intermediate plate 39 is so shaped and dimensioned that at the two side edges 41 of the base 40 two essentially T-shaped recesses 42 are formed between the base 40 and the top plate 38, which latter is slightly smaller on all four sides than the base 40 although it is thicker than the latter. Along its side adjacent to the top panel 37, the top and intermediate plates 38, 39 have an elongated rectangular slit 43. The top panel 37 is also of laminated construction having a base 44 and a top plate 45 which is smaller in area than the base 44 and is provided at the edge adjacent the side plate 34 with a projection 46 of a shape complementary to the slot 43.

The side of the top panel 37 remote from the panel 34 is provided with an extension 47 connected to the adjacent edge of the panel 37 via a pair of undercut slots 48. The extension 47 has on each side a tongue 49 and a shoulder 50; it also has a central flap 51.

The end panels 36 are essentially identical and therefore only one will be described. Each end panel 36 is essentially rectangular and may have a central window 52, (although this is not essential) to allow printed matter on the flaps 61 to be viewed without undoing the assembled box. The edge of the panel 36 remote from the base has a flap 53 having a rounded side edge 54 and an opposite bevelled side edge 55. Each flap 53 has a small plate 56 secured thereto which does not extend across the full width of the flap and does not overlie bevelled edge 55; neither does it quite extend to the adjacent fold line.

The side panel 35 is also of laminated construction. It has a top plate 57 secured to a slightly larger bottom plate 58 by means of an intermediate piece cut away to provide a stepped recess 60 of a shape complementary to tongues 49 shoulders 50 and flap 51 of the top panel 37. From the two shorter edges of the panel 35 a pair of similar flaps 61 extends in the same direction as the end panels 36. However, the flaps 61 are longer than the end panel 36 and in fact their length corresponds to the width of the base panel 31. The flaps 61 terminate in arcuate tongues 62. The tongues 62 are adapted, on first folding about the line at their base and a second folding about the line between the tongues 62 and the rest of the flaps 61, to fit into the T-shaped recesses 42 of the side panel 34.

With reference to FIGS. 4 to 6 the assembly of the box blank 30 is as follows.

Assuming the blank 30 to be laid out in a horizontal plane, with the package blanks 11 safely held in position by means of the security strips 24 and bars 26 and collars 27 the two side panels 34 and 35 are folded along their fold lines so as to bring them into a vertical position. Then the flaps 61 are bent about a vertical axis to bring the tongues 62 into engagement in the T-shape recesses 42 in the side panel 34 whereby the two side panels are securely held in a vertical position. Then the end panels 36 are folded to overlie the flaps 61 and finally the top panel is folded over, causing the projection 46 to engage in and abut the slot 43. The flap 47 is then folded to fit securely into the stepped recess 60.

When the flap 47 is fully engaged in the recess 60 the bevelled edges 55 of the end panels 36 will engage and locate in the cut-out slots 48 whereafter the box will be tamper-proof, i.e. will not be openable again without damaging it. If therefore it is desired to re-use the box repeatedly, as may often be the case, then the slots 48 are omitted.

Figure 7:
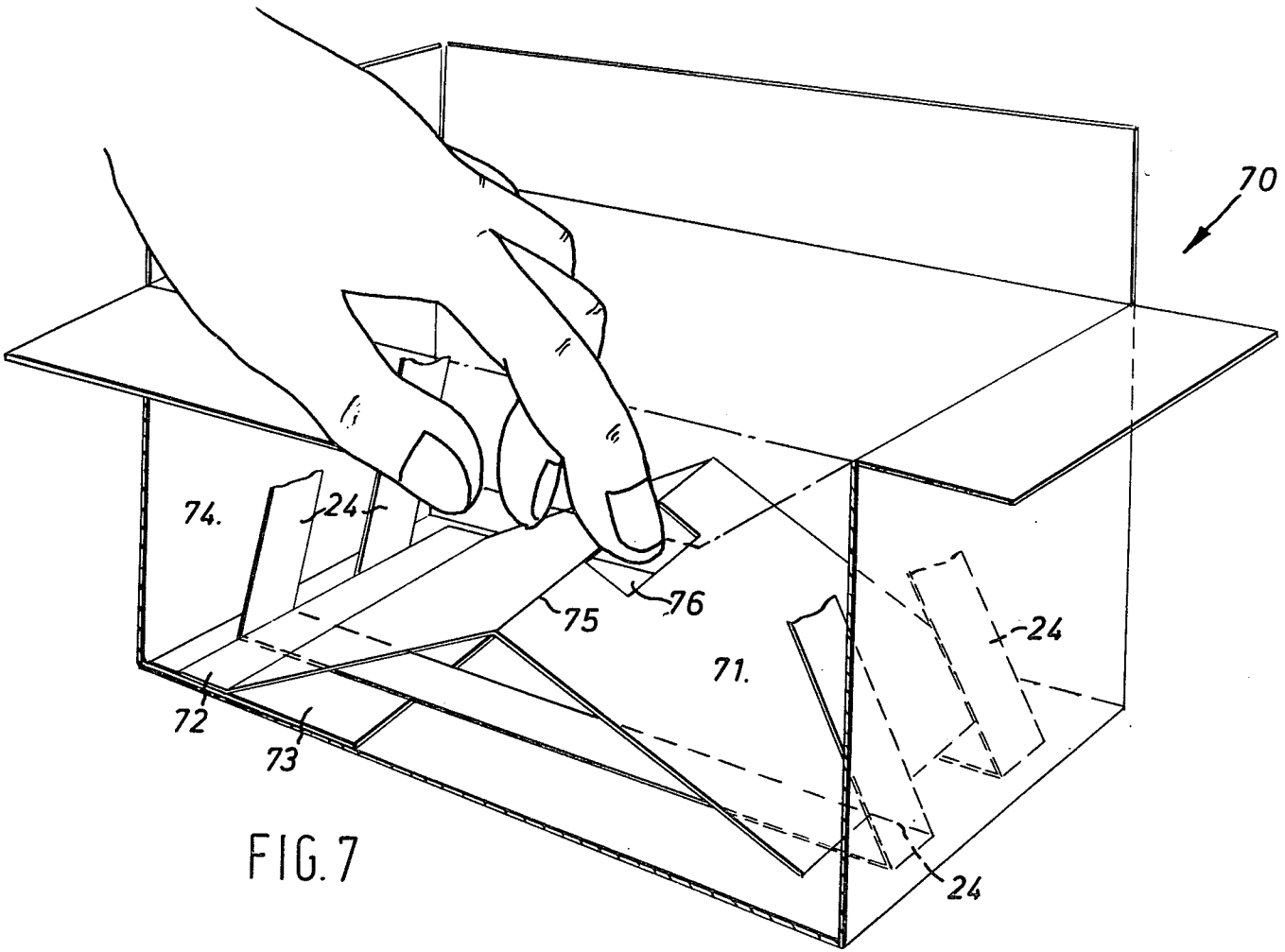

Referring now to FIG. 7 there is shown a box of generally conventional construction but incorporating the security strips previously described. Furthermore, the box 70 has a false bottom 71 which is raisable to allow access to the strips 24 for removal or exchange thereof. A strip-shaped part 72 of the false bottom 71 is secured e.g. by glueing to a flap 73 constituting a folded extension of the adjacent side panel 74. A fold line 75 is provided intermediate the ends of the bottom 71 and along that fold line 75 there is finger-size hole or cut-out 76. To lift the bottom 71 a finger is inserted into the hole 76 and then the bottom 71 can be lifted to hinge about the fold line 75 while remaining secured by the glued strip 72.

What is claimed is:

1. In boxes for containing a plurality of stacked plate-like members such as fold-flat package blanks where the box comprises a base panel and side panels surrounding the members, the improvement for indicating if a member has been removed from box comprising:

(a) a security strip connected to the base panel and passing across the tops of the members, said security strip being of a frangible material and held sufficiently close adjacent the tops of the members that a member can only be removed by breaking said security strip;

(b) a rigid bar substantially as long as the inside dimension of the box parallel to said security strip and disposed beneath said security strip in parallel relationship thereto and on top of the members; and, (c) means for securing said bar to said security strip whereby said security strip is held close adjacent the tops of the members and said bar assists in breaking said security strip if an attempt is made to remove one of the members from the box, said means for securing said bar to said security strip comprising a collar slidably threaded on the bar and around said security strip, said collar being of a length and position such that said bar cannot be rotated out from under said security strip and removed from beneath said security strip without said collar breaking a portion of said security strip sufficient to indicate tampering.

2. In boxes for containing a plurality of stacked plate-like members such as fold-flat package blanks where the box comprises a base panel and side panels surrounding the members, the improvement for indicating if a member has been removed from the box comprising:

(a) a security strip connected to the base panel and passing across the tops of the members, said security strip being of a frangible material and held sufficiently close adjacent the tops of the members that a member can only be removed by breaking said security strip; and wherein, (b) the base panel has a conduit formed therein;

(c) said security strip is formed into a loop passing through said conduit and having the free ends fastened together with sealing means for indicating if said free ends have been unfastened; and, (d) said base panel includes a false bottom hingedly secured at one end thereof to said base panel, the other end being free, and intermediate its ends said false bottom is provided with a fold line and finger-engageable means for lifting it and pivoting it about the said fold line which passes through said finger-engageable means so as to provide access to said conduit for positioning a security strip therein.

3. A security box for containing a plurality of stacked plate-like members such as fold-flat package blanks, said box comprising:

(a) a planar rectangular base panel having four rectilinear side edges;

(b) four side panels attached to and surrounding said four side edges, respectively, said base panel and said side panels forming an enclosure and being of sufficient strength and rigidity to support the weight of the plate-members therein; and, (c) security means for indicating if a said plate-like member has been removed from said box, said security means comprising a strip extending from said base panel upwardly around the plate-like members and normal thereto inwardly of an opposed pair of said side panels which said side panels are parallel to said members, said strip having ends joined above the plate-like members, a rigid bar disposed beneath said joined ends of said strip, means for securing said bar to said strip with said bar extending over the plate-like members normal thereto in closely spaced relationship therewith and spanning said opposed pair of said panels, said securing means comprising a collar encircling and slidable along said bar and said security strip, said strip being of a material having the frangible characteristics of paper whereby the plate-like members are incapable of being removed from the box without breakage of said strip, said collar being of a length and position such that said bar cannot be rotated out from under said security strip and removed from beneath said security strip without said collar breaking a portion of said security strip sufficient to indicate tampering.

* * * * *